United States Patent [19]

Prengaman et al.

[11] 4,236,978

[45] Dec. 2, 1980

[54] STABLE LEAD DIOXIDE ANODE AND METHOD FOR PRODUCTION

[75] Inventors: Raymond D. Prengaman, Arlington; Herschel B. McDonald, Red Oak, both of Tex.

[73] Assignee: RSR Corporation, Dallas, Tex.

[21] Appl. No.: 119,743

[22] Filed: Feb. 8, 1980

[51] Int. Cl.[3] ..... C25B 1/30; C25B 11/02; C25B 11/12; C25B 11/16

[52] U.S. Cl. ..... 204/57; 204/290 R; 204/294

[58] Field of Search ..... 204/57, 290 R, 294

[56] References Cited

U.S. PATENT DOCUMENTS

| | | | |
|---|---|---|---|
| 2,492,206 | 12/1949 | White et al. | 204/57 |
| 2,631,115 | 3/1953 | Fox | 204/57 |
| 2,872,405 | 2/1959 | Hatfield et al. | 204/290 |
| 2,945,791 | 7/1960 | Gibson | 204/57 |
| 3,463,707 | 8/1969 | Gibson et al. | 204/15 |
| 3,880,728 | 4/1975 | Habermann et al. | 204/38 A |
| 4,008,144 | 2/1977 | Torikai et al. | 204/57 |
| 4,026,786 | 5/1977 | Fukuayashi et al. | 204/290 F |
| 4,159,231 | 6/1979 | Smith et al. | 204/57 |

*Primary Examiner*—R. L. Andrews
*Attorney, Agent, or Firm*—Watson, Leavenworth, Kelton & Taggart

[57] ABSTRACT

An improved insoluble anode for electrowinning is described which comprises a graphite substrate covered by a tight fitting sheet of a nonconductive electrolytically inert mesh material over which covered substrate is electrodeposited a layer of lead dioxide. The anode is formed by covering the graphite substrate with a sheet of the inert mesh material and thereafter electrodepositing lead dioxide thereon until a smooth layer of lead dioxide completely covers the mesh material. The anodes are electrolytically stable and are not susceptible to cracking.

11 Claims, No Drawings

STABLE LEAD DIOXIDE ANODE AND METHOD FOR PRODUCTION

BACKGROUND OF THE INVENTION (a.) Field of the Invention

This invention relates to insoluble lead dioxide coated graphite anodes for electrowinning materials.

(b.) Description of the Prior Art

Lead dioxide is suitable as a coating on anodes due to its relatively show rate of erosion in many electrolyte systems. In contrast, the base materials on which the lead dioxide is commonly deposited are easily eroded by many electrolyte systems. Access to such base materials having lead dioxide coatings commonly occurs via pinholes or other defects resulting from the coating process. In addition lead dioxide has shown a tendency to flake or crack during normal handling due to its inherent brittleness and its poor adhesion to the base anode material.

A number of methods have been proposed to overcome the problems attending use of lead dioxide coated anodes. For example, U.S. Pat. No. 2,872,405 describes an improved anode comprising a metal screen on which there is electrodeposited a lead dioxide coating and the interstices of which are completely filled with lead dioxide. The anode has enhanced mechanical strength, less tendency to crack during handling, and is less susceptible to breakdown during operation.

U.S. Pat. No. 2,945,791 proposes to improve the quality of the lead dioxide coating on graphite or carbon electrodes by electrodepositing the coating from a special lead nitrate electrolyte employing a specific sequence of operating steps, including a water soak of the substrate material to eliminate pinholes in the coating and agitation during electrodeposition to wipe bubbles off the base material. U.S. Pat. No. 3,463,707 employs an electrolyte in which high acid levels are maintained to electrodeposit a thin and then a second thick layer of lead dioxide on the anode in order to produce a better product. In U.S. Pat. No. 3,880,728 lead dioxide is electrodeposited on a titanium substrate following deposition of an intermediate carbide, boride or silicide layer. U.S. Pat. No. 4,026,786 describes electrodeposition of lead dioxide onto titantium substrates from electrolytes containing high levels of nitric acid in order to produce more satisfactory anodes without necessity for precoating or use of fluoride additives. Finally, U.S. Pat. No. 4,159,231 employs alternating current in conjunction with direct current during lead dioxide deposition to extend anode life.

SUMMARY OF THE INVENTION

The invention comprises an improved insoluble anode having a graphite substrate with a close-fitting sheet of nonconductive inert mesh material or cloth thereover coated with a layer of electrodeposited lead dioxide. The invention further comprises a method for making such improved insoluble anodes by covering a graphite substrate with a tight-fitting sheet of electrolytically inert mesh material and thereafter electrodepositing lead dioxide thereon from an electrolyte having a lead level above about 40 g/l until a smooth layer of lead dioxide completely covers the mesh material. The anodes produced in accordance with the invention are relatively resistant to deterioration both in handling and during electrolysis.

DETAILED DESCRIPTION OF THE INVENTION

The invention comprises a dimensionally stable, crack resistant insoluble anode for use in electrowinning and a method for producing such an electrode. The anode of the invention is a lead dioxide coated graphite anode having a mesh reinforcement.

More specifically the anode of the invention comprises a graphite substrate, an electrolytically inert, nonconductive cloth forming a close-fitting covering on the substrate and lead dioxide electrodeposited thereover. The anode is formed in accordance with the invention by covering a graphite substrate with a sheet of the inert mesh material. Lead dioxide is thereupon deposited on the covered graphite until a layer of hard, dense bluish-black lead dioxide completely covers the mesh material. By means of the mesh material defects in the anode surface resulting from oxygen evolution during electrodeposition are avoided and the lead dioxide layer is reinforced thereby preventing cracking, flaking or other damage to the lead dioxide coating during handling and use.

The cloth which may be employed as the mesh covering on the graphite substrate must be of a nonconductive material which is not reactive with or dissolved by the electrolyte solutions employed in the electrodeposition of the lead dioxide. For purposes of the present aplication, the terms "inert" or "electrolytically inert materials" refer to materials which exhibit the requisite resistance to the electrolyte solutions and electrolytic processes employed. Materials such as polyesters, polyethylene, polypropylene, teflon and polyvinylchloride typically are sufficiently inert to common electrolytes to permit use in the present invention. On the other hand, materials which deteriorate in an electrolyte are unsuitable for use in the practice of the present invention. For example, nylon is not suitable for use in a fluoboric electrolyte.

The inert material which is employed in the practice of the invention must be in a form which is sufficiently porous or loosely woven to permit penetration of the lead dioxide therethrough. On the other hand, meshes of large size and particularly large regularly spaced mesh materials in general require very thick coatings of $PbO_2$ to completely cover the threads. Thus, the weave or mesh of the material is preferably sufficiently loose on the one hand to permit ready penetration of the interstices by the lead dioxide and sufficiently tight on the other to permit complete coating within a reasonable time.

Regular structures associated with woven meshes tend to produce pin holes at the interstices of the fibers. These can be eliminated if the coating process is continued until the mesh in completely covered. Regular or woven meshes can result in cracks in the outer $PbO_2$ layers if the layers propogate along the threads in a uniform manner. In addition, the reinforcement of the $PbO_2$ is directional. In contrast the random orientation of the fibers in nonwoven meshes produces no directional weakness in the deposited $PbO_2$. Thus, nonwoven fabric meshes with randomly oriented fibers are more resistant to cracking when used in reinforcing $PbO_2$ layers deposited on graphite substrates. Such nonwoven fabrics are thus preferred for use in the practice of the present invention.

The thickness of the mesh material will affect the amount of $PbO_2$ which must be deposited to form a uniform complete coating. In order to avoid the necessity of thick, heavy $PBO_2$ coatings, it is preferred that the mesh material be of relatively small gauge fiber and be relatively thin. Felts of up to about 20 mils thickness have been found to be highly suitable in the practice of the present invention, although it is possible to cover materials of much greater thickness.

In making the anode of the invention, a substrate, such as graphite, is covered with a layer of the inert mesh material. It is desirable to provide a relatively close covering since it is believed that the advantages of the present invention derive in part from the fact that any oxygen evolved during electrodeposition of the lead dioxide will form on the cloth surface rather than on the lead dioxide or substrate surface. Interference with coating of the lead dioxide on the substrate is thereby avoided. Loose meshes require thick $PbO_2$ deposits to completely cover the material and thus the anode gets very thick and very heavy. On the other hand, during plating, the mesh, though preferably adherent, should not be too tight. If it is too tight, the edges of the anode will preferentially coat and the center area may not plate well where the cloth is gapped. Thus, it is preferred that the cloth be neither too tight nor too loose fitting. For purposes of the present application references to the relatively close- or tight-fit of the mesh materials is intended to mean a preferred fit which meets the above requirements, while avoiding the above problems.

The covered graphite material is coated with lead dioxide according to conventional lead electrodeposition techniques. Steps employed in conventional practice to prepare the graphite for plating are not, however, required. Thus beyond rounding of the graphite edges, no further surface preparation of the substrate is required. Further, heating of the solution during electrodeposition is not required, but will not interfere with the process.

Any electrolyte solution suitable for lead peroxide electrodeposition may be employed. For example, the electrolyte solution employed can be $HBF_4$, $H_2SiF_6$, $HNO_3$, acetic acid or other conventional electrolyte solutions in which lead is soluble, and from which a hard dense $PbO_2$ layer can be deposited. Fluoboric and nitric acid solutions appear to give the best $PbO_2$ deposits and thus are preferred.

In the electrocoating process, the lead level in the electrolyte should be maintained above 40 g/l for optimum results. At lower lead levels, the deposit is converted from a hard, dense, bluish-black $PbO_2$ to a softer, granular brown $PbO_2$ layer which does not adhere well to the graphite or cloth substrate.

The purity of the electrolyte solution is not critical provided excessive amounts of impurities are avoided. Specifically, materials which cause gassing at the anode should not be present in large amounts. However, since initial gassing occurs on the outside surface of the mesh materials, rather than at the lead dioxide-graphite interface, small amounts of such impurities may be present and high purity levels required without the presence of the presently employed mesh cloth are not required.

In particular, pressence of arsenic, selenium or other ions which promote the formation of $O_2$ at the anode and thus interfere with the deposition of $PbO_2$ on the anode surface should be avoided. However, small amounts of As or Se may be present when using the instant cloth reinforcement method, but should not exceed 5 ppm for optimum coating. Iron present as $Fe^{++}$ ions will be oxidized to the $Fe^{+++}$ state at the anode. This could react with the $PbO_2$ being deposited on the anode and give poor plating. Sulfate ions will react with the lead in solution and produce $PbSO_4$; thus, only small amounts of the sulfate can remain in solution. $PbCl_2$ can also be formed if chloride ions are present. Presence of such ions in the electrolyte solution is, thus, preferably avoided.

Surfactants, which are normally added to electrolytes to raise the oxygen overvoltage at the anode, inhibit gassing and improve the throwing power of the electrolyte, are not required in the present electrodeposition process. $CuNO_3$ and $NiNO_3$ which result in preferential deposition of copper or nickel at the cathode and prevent depletion of lead as metallic lead also are not required, but can be used.

The solution may contain leveling agents such as glue or organics to give a smooth deposit of lead at the cathode. It may also contain ions, such as copper, which deposit on the cathode instead of the lead depositing on the cathode and depleting the solution of lead at twice the rate.

The inert material covered-graphite anode is immersed in a lead containing electrolyte solution as above described employing a suitable cathode and is subjected to a current of between about 5 and 100 amps/sq. ft. Generally, for best results the current density should be kept low during the initial $PbO_2$ deposition (about 10–15 A/sq ft.) to avoid gassing. Once the $PbO_2$ has penetrated the cloth mesh, the amperage can be raised to much higher levels to rapidly complete the covering of the mesh. The coating process can be carried out at room temperature or elevated temperature as desired. During electrodeposition, to insure optimum plating, the electrolyte solute should be circulated to maintain a uniform lead concentration at the anode. The thicker the mesh layer, the longer is the time to complete the $PbO_2$ plating and the heavier is the finished anode.

During coating of the graphite using conventional techniques, the current must not be interrupted or a nonadherent layer of $PbO_2$ will form over the previously deposited $PbO_2$. Using the cloth fiber reinforcing layer over graphite in accordance with the present invention, once the initial adherent $PbO_2$ layer is formed beneath and through the cloth, the current can be interrupted and restarted to continue to form the outer coating over the cloth. A non-adherent layer will form over the $PbO_2$ which has penetrated the cloth, but an adherent layer will form over the exposed surface of the cloth to give a complete hard, dense, compact layer of $PbO_2$ over the cloth reinforcement. Once the cloth has been fully covered with $PbO_2$, interruption and restarting of the current will produce a nonadherent layer of $PbO_2$.

During the electrodeposition process $PbO_2$ is deposited beneath the mesh cover onto the graphite while lead is deposited at the cathode. As the $PbO_2$ layer builds, it grows through the openings in the mesh of the cloth and begins to form a layer on the outside of the cloth. The coating process is complete when the $PbO_2$ has completely covered the cloth and forms a smooth, slightly nodular adherent layer. As previously noted, the time and thickness required for such coating will depend on such factors as the mesh size, uniformity of mesh, closeness of mesh material to graphite substrate and thickness of the mesh material.

The $PbO_2$ coating formed on a graphite anode in the manner described is fiber reinforced by the mesh of the cloth. In essence, the resultant anode comprises 4 layers:

1. The graphite core
2. The $PbO_2$ layer beneath the cloth
3. The cloth fiber reinforcing layer
4. The outer $PbO_2$ layer.

Anodes coated in accordance with the invention can be handled without fear of damaging the outer $PbO_2$ layer because it is reinforced by the fibers which prevent cracking of the $PbO_2$. Even if the outer layer is damaged, the $PbO_2$ inner layer beneath the cloth will prevent access of the electrolyte to the graphite substrate and its subsequent deterioration.

The anodes formed in accordance with the invention may be used for electrowinning a number of metals. Specifically the anodes have been found suitable for use in lead, copper, antimony and nickel electrowinning.

EXAMPLE 1

A graphite substrate 13"×36"×½" was covered by a tightly adherent layer of scrimmed and singed polyester filtration cloth weighing 9.0 oz./yd$^2$ and about 75 mils thick. The graphite-felt anode was thereupon immersed in a electrolyte of 130 g/l lead, 160 g/l $HBF_4$, 8 g/l $H_3BO_3$ and 0.5 g/l animal glue to a depth of 33 inches. Stainless steel cathodes 15"×36" were used and a current of 10 sq ft was applied without interruption for a period of 72 hours. At this time a smooth, slightly nodular layer of hard, dense bluish black lead dioxide completely covered the felt. A total of 40 lbs of $PbO_2$ was deposited or 13.4 lb/sq ft of anode surface area. The plating was between 3/16 and ⅜" thick with the deposit thicker on the edges than on the flat surfaces. The anodes were used in an electrowinning cell for a period of 8 months with no evidence of deterioration of the $PbO_2$ layer.

EXAMPLE II

A graphite substrate 13"×36"×½" was covered with a tightly adherent layer of Dupont Reemay Filtration cloth #2431 crimped polyester fiber 16–20 mils thick weighing 2.4 oz/yd$^2$. The graphite-felt combination was immersed in a solution of 130 g/l lead, 16% $HBF_4$, 8 g/l $H_3BO_3$, and 0.2 g/l glue. The anode was immersed to a depth of 30". A stainless steel cathode 15"×36"×⅛" was employed. A current of 9–10 A/sq ft was applied for a period of 17 hours. The current was increased to 12–13 A/sq ft for an additional 24 hours.

A total of 28 lb of $PbO_2$ was deposited or 10 lb/square foot of anode surface area. The coating was very uniform and much smoother than that produced with the heavy felt of Example 1. Some small areas were not completely coated through the felt due to a slight buckling of the fabric away from the graphite.

EXAMPLE III

The same graphite substrate described above in Example 2 was covered with Dupont #2416 crimped fiber polyester filter cloth 12–16 mil thick weighing 1.5 oz/yd$^2$. The plating area and electrolyte was the same as described in Example 2. The current of 9–10 A/sq ft$^2$ was applied for 17 hours and 12–13 A/ft$^2$ for 31 hours.

A total of 34 lb of $PbO_2$ was deposited. The coating was not uniform or as complete as Example 2 due to buckling of the fabric away from the graphite because the fabric was pulled too tight.

EXAMPLE IV

A graphite anode 4"×6"×½" was covered by a tight layer of polyester woven mesh having 9 ×8 threads/1 inch. The anode was immersed in a solution of 120 g/l lead, 160 g/l $HBF_4$, 7 g/l $H_3BO_3$ and 0.2 g/l glue to a depth of 4½". Stainless steel anodes 6"×4½" were used. A current of 12 A/ft$^2$ was applied for 7.25 hours, 8 A/ft$^2$ for 16.5 hours, and 24 A/ft$^2$ for 5.0 hours. A total of 375 g of $PbO_2$ was deposited giving a thickness of about ⅛". There was some gassing initially at the fabric, but at the end of the plating test, the fabric was completely covered with a dense, hard layer of $PbO_2$.

EXAMPLE V

A graphite anode 4"×6"×½" was covered by a tight layer of polyester woven mesh as described in Example 4. The anode was immersed in a solution of 80 g/l lead, 150 g/l $HNO_3$ and 2 g/l glue to a depth of 4½ inches. Stainless steel cathodes 2½"×4½" were used. A current (anode) density of 20 A/sq ft was applied for 24 hours to deposit 550 g of $PbO_2$. At the end of the test, the anode was completely covered with a dense, nodular, layer of hard bluish black $PbO_2$.

We claim:

1. A method for producing a stable lead dioxide coated insoluble anode, which comprises:

(a) covering a graphite substrate with a nonconductive tight-fitting inert cloth;

(b) electrodepositing a hard, dense lead dioxide layer on the covered graphite substrate from an electrolyte in which the lead level is maintained above about 40 g/l until the mesh material is completely coated with a layer of lead dioxide.

2. The method of claim 1 wherein the electrolyte is a fluoboric acid solution.

3. The method of claim 1 wherein the electrolyte is a nitric acid solution.

4. The method of claim 1 wherein the current density applied during step (b) is kept between about 10 and 15 A/sq ft until the $PbO_2$ has penetrated the cloth.

5. An insoluble anode for use in electrowinning which comprises a graphite substrate covered with a mesh of nonconductive inert material coated with a layer of electrodeposited lead dioxide.

6. The anode of claim 1 wherein the inert material is selected from the group consisting of polyester, polypropylene, polyethylene, teflon and polyvinylchloride.

7. The anode of claim 1 wherein the inert material is polyester.

8. The anode of claim 1 wherein the inert material is nonwoven.

9. The anode of claim 1 wherein the inert material is a nonwoven polyester felt.

10. The anode of claim 1 wherein the mesh forms a relatively tight fitting cover on the graphite substrate.

11. An improved insoluble anode having a graphite substrate and an electrodeposited lead dioxide coating thereon wherein the improvement comprises a sheet of inert mesh material covering the graphite with the lead dioxide electrodeposited thereover.

* * * * *

UNITED STATES PATENT AND TRADEMARK OFFICE

CERTIFICATE OF CORRECTION

PATENT NO. : 4,236,978

DATED : December 2, 1980

INVENTOR(S) : Raymond D. Prengaman and Herschel B. McDonald

It is certified that error appears in the above-identified patent and that said Letters Patent are hereby corrected as shown below:

Column 1, line 11, "show" should read --slow--.

Column 2, line 29, "aplication," should read --application--.

Column 3, line 62, "pressence" should read --presence--.

Claim 6, line 1, "claim 1" should read --claim 5--.

Claim 7, line 1, "claim 1" should read --claim 5--.

Claim 8, line 1, "claim 1" should read --claim 5--.

Claim 9, line 1, "claim 1" should read --claim 5--.

Claim 10, line 1, "claim 1" should read --claim 5--.

Signed and Sealed this

*Seventeenth* Day of *August 1982*

[SEAL]

*Attest:*

GERALD J. MOSSINGHOFF

*Attesting Officer*

*Commissioner of Patents and Trademarks*